US009871292B2

(12) United States Patent
Turner

(10) Patent No.: US 9,871,292 B2
(45) Date of Patent: Jan. 16, 2018

(54) STEERABLE SATELLITE ANTENNA ASSEMBLY WITH FIXED ANTENNA FEED AND ASSOCIATED METHODS

(71) Applicant: Harris Corporation, Melbourne, FL (US)

(72) Inventor: Gregory M. Turner, West Melbourne, FL (US)

(73) Assignee: HARRIS CORPORATION, Melbourne, FL (US)

( * ) Notice: Subject to any disclaimer, the term of this patent is extended or adjusted under 35 U.S.C. 154(b) by 241 days.

(21) Appl. No.: 14/818,521

(22) Filed: Aug. 5, 2015

(65) Prior Publication Data

US 2017/0040684 A1 Feb. 9, 2017

(51) Int. Cl.

| | |
|---|---|
| ***H01Q 1/28*** | (2006.01) |
| ***H01Q 13/00*** | (2006.01) |
| ***H01Q 3/20*** | (2006.01) |
| ***H01Q 19/19*** | (2006.01) |

(52) U.S. Cl.

CPC ..... *H01Q 3/20* (2013.01); *H01Q 1/288* (2013.01); *H01Q 19/192* (2013.01)

(58) Field of Classification Search

None

See application file for complete search history.

(56) References Cited

U.S. PATENT DOCUMENTS

| | | | | |
|---|---|---|---|---|
| 4,668,955 A | | 5/1987 | Smoll | |
| 4,690,354 A | * | 9/1987 | Frisch | B64G 1/1007 244/158.1 |
| 4,862,185 A | * | 8/1989 | Andrews | H01Q 3/20 343/761 |
| 5,198,827 A | | 3/1993 | Seaton | |
| 6,107,973 A | * | 8/2000 | Knop | H01Q 17/001 343/781 CA |
| 6,342,865 B1 | * | 1/2002 | Chandler | H01Q 3/20 343/765 |
| 6,492,955 B1 | * | 12/2002 | Amyotte | H01Q 3/20 343/755 |
| 6,747,604 B2 | | 6/2004 | Amyotte et al. | |
| 7,411,561 B1 | * | 8/2008 | Baldauf | H01Q 19/192 343/761 |
| 2002/0140617 A1 | * | 10/2002 | Luly | H01Q 19/132 343/781 CA |
| 2007/0216573 A1 | * | 9/2007 | Handermann | G01S 19/39 342/357.22 |

(Continued)

OTHER PUBLICATIONS

Borisov et al. "Mirror antenna with mechanical beam scanning" Source: Izvestiya Vysshikh Uchebnykh Zavedenij. Radioelektronika, v 45, n 3, p. 68-70, 2002 Language: Russian.

(Continued)

*Primary Examiner* — Trinh Dinh

(74) *Attorney, Agent, or Firm* — Allen, Dyer, Doppelt + Gilchrist, P.A.

(57) ABSTRACT

An antenna assembly to be carried by a satellite includes an antenna feed configured to extend outwardly from the satellite, and a frame rotatably carried by the antenna feed and is rotatable about a first rotation axis. A main reflector is carried by the frame and is aligned with the antenna feed. A splash plate is carried by the frame in spaced apart relation from the main reflector and is rotatable about a second rotation axis.

22 Claims, 4 Drawing Sheets

(56) References Cited

U.S. PATENT DOCUMENTS

2014/0225788 A1* 8/2014 Schulz ..... G06F 3/0482
343/702
2016/0072185 A1* 3/2016 Lanciault ..... H01Q 3/20
343/761

OTHER PUBLICATIONS

Lorenzo et al, Inexpensive scanning dual offset reflector antenna with rotating flat subreflector IEEE Antennas and Propagation Society, AP-S International Symposium (Digest), v 2, p. 1178-1181, 1995.

* cited by examiner

STEERABLE SATELLITE ANTENNA ASSEMBLY WITH FIXED ANTENNA FEED AND ASSOCIATED METHODS

FIELD OF THE INVENTION

The present invention relates to the field of wireless communications, and more particularly, to a steerable antenna assembly for a satellite and related methods.

BACKGROUND

Steerable satellite antenna assemblies for satellite-to-ground links typically require high gain, low mass, and high reliability. One approach for a steerable satellite antenna assembly is to use a fixed feed source so as to eliminate performance degradations otherwise associated with a moving feed source. Performance degradations for a moving feed source typically include losses due to mechanical rotary joints, RF cable connectors, flexible waveguides, and lengthy cables associated with rotary actuators.

Steerable satellite antenna assemblies also need to avoid the "keyhole effect," which is a physical limitation due to the orientation of the antenna rotation axis caused by a limited motion range of the actuators. The keyhole effect causes the antenna to momentarily disrupt communications when reaching its physical limitation so as to allow for the actuators to reposition before resuming steering.

One approach for a steerable satellite antenna assembly with a fixed antenna feed is disclosed in U.S. Pat. No. 6,492,955 to Amyotte et al. The antenna assembly includes a subreflector secured to a frame rotatably mounted on a support structure via a first motor, and an antenna feed located at a first focus of the subreflector for illuminating the same. The antenna feed is fixed to the structure and has a feed axis pointing at the subreflector. A parabolic reflector having a focus in common with a second focus of the subreflector to transfer the signal between the same, and a planar reflector is secured to the frame, and has a beam axis. The planar reflector is rotatably mounted on the frame via a second motor to transfer the signal between the parabolic reflector and a target. The antenna assembly includes a controller connected to the motors to steer at the target anywhere within a full spherical angular range.

Another approach for a steerable satellite antenna assembly with a fixed antenna feed is disclosed in U.S. Pat. No. 5,198,827 to Seaton. The antenna assembly includes an antenna feed structure for emitting electromagnetic radiation, and a subreflector for redirecting the emitted radiation. A main antenna reflector projects radiation redirected by the subreflector as an antenna beam. A mechanical arrangement rotates the subreflector about the rotation point.

Even in view of the above steerable satellite antenna assemblies, there is still a need for such assemblies to have a more compact geometry. Continued growth and demand for bandwidth has led to new commercial satellite constellations. For example, the O3b satellite constellation is deployed in a medium earth orbit (MEO) and the OneWeb satellite constellation is to be deployed in a low earth orbit (LEO). A more compact antenna assembly reduces the size and weight of the satellites, as well as costs. In addition, MEO and LEO satellites typically operate at a wider beam scanning range as compared to a traditional geosynchronous orbit. Consequently, another desirable attribute is for the compact antenna assemblies to also operate over a wider scanning range.

SUMMARY

An antenna assembly to be carried by a satellite according to the invention comprises an antenna feed configured to extend outwardly from the satellite, a frame rotatably carried by the antenna feed and rotatable about a first rotation axis, and a main reflector carried by the frame and aligned with the antenna feed. A splash plate may be carried by the frame in spaced apart relation from the main reflector, and may be rotatable about a second rotation axis.

Since the antenna assembly does not require a subreflector, this allows for the antenna assembly to have a more compact geometry. A compact antenna assembly reduces the size and weight of the satellite. Satellite cost is also reduced since less parts are used.

The antenna feed and mounting interface may have an L-shape. The main reflector may be fixed to the frame. The main reflector may have a parabolic shape, and the splash plate may have a flat shape. The antenna feed and main reflector may be configured to operate in at least one of the Ka-frequency band and the Ku-frequency band.

The antenna assembly may further comprise a first rotational actuator coupled between the antenna feed and the frame, and a second rotational actuator coupled between the frame and the splash plate. The first rotation axis may provide azimuthal positioning, and the second rotation axis may provide elevational positioning.

Another aspect is directed to a satellite comprising a housing, communications circuitry carried by the housing, and an antenna assembly also carried by the housing. The antenna assembly may be as described above.

Yet another aspect is directed to a method for making an antenna assembly as described above. The method may comprise positioning an antenna feed to extend outwardly from the satellite, and positioning a frame to be rotatably carried by the antenna feed. The frame may be rotatable about a first rotation axis. A main reflector may be positioned to be carried by the frame and be aligned with the antenna feed. A splash plate may be positioned to be carried by the frame in spaced apart relation from the main reflector. The splash plate may be rotatable about a second rotation axis.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
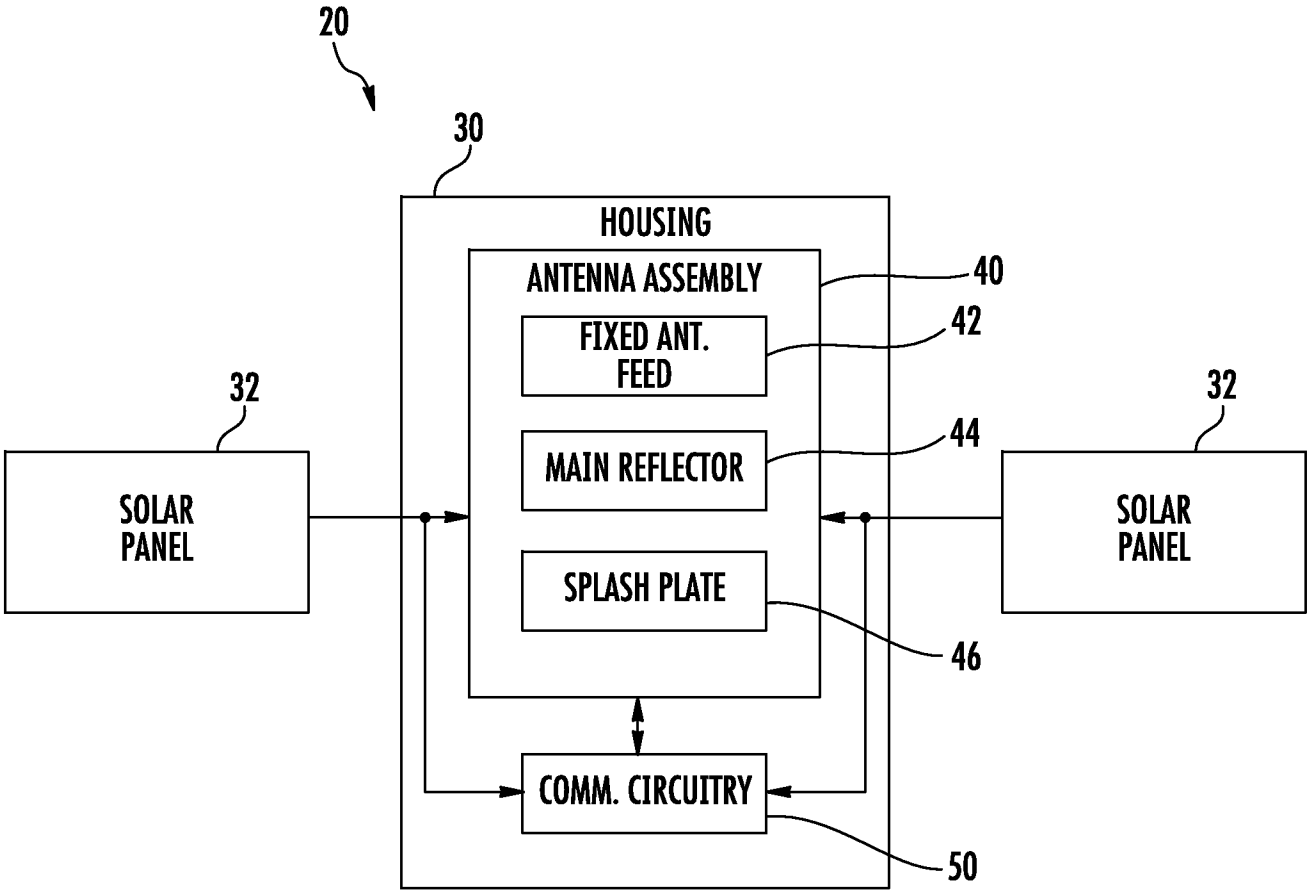
FIG. 1 is a block diagram of a satellite with a steerable antenna assembly in accordance with the present invention.
Figure 2:
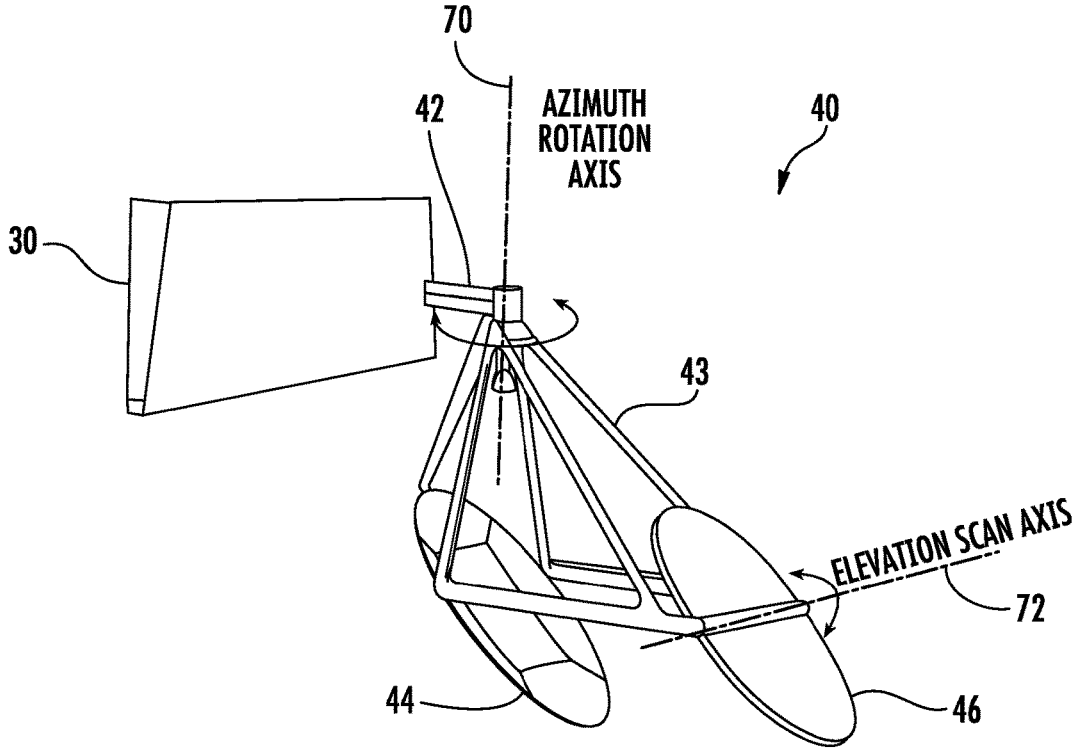
FIG. 2 is a perspective view of the steerable antenna assembly illustrated in FIG. 1.

Referring initially to FIGS. 1 and 2, an antenna assembly 40 to be carried by a satellite 20 will be discussed. The satellite 20 includes a housing 30, communications circuitry 50 carried by the housing, and the antenna assembly 40 also carried by the housing. The antenna assembly 40 includes a fixed antenna feed 42, a main reflector 44, and a splash plate 46. Power for the satellite 20 is provided by solar panels 32 extending outwards from the housing 30.

The fixed antenna feed 42 is configured to extend outwardly from the satellite housing 30, as illustrated in FIG. 2. A frame 43 is rotatably carried by the antenna feed 42 and is rotatable about a first rotation axis 70. The main reflector 44 is carried by the frame 43 and is aligned with the antenna feed 42. The splash plate 46 is carried by the frame in spaced apart relation from the main reflector 44 and is rotatable about a second rotation axis 72.

The first rotation axis 70 provides azimuthal positioning, and the second rotation axis 72 provides elevational positioning. The antenna feed has an L-shape and the main reflector 44 is fixed to the frame 43. The main reflector 44 has a parabolic shape, and the splash plate 46 has a flat shape.

In a transmit mode, RF signals from the antenna feed 42 are directed to the main reflector 44. The main reflector 44 reflects the RF signals to the splash plate 46 which is then positioned to direct the RF signals to an intended transceiver. The intended transceiver may be on the ground or on an air-borne platform, for example. In a receive mode, the transmit path is reversed.

Since the antenna assembly 40 does not require a subreflector, this allows for the antenna assembly to have a more compact geometry. A compact antenna assembly reduces the size and weight of the satellite 20. Satellite cost is also reduced since less parts are used.

In the illustrated embodiment, the communications circuitry 50 and the antenna assembly 40 are configured to operate in the Ka-band, which corresponds to 17-29 GHz. Alternatively, the communications circuitry 50 and the antenna assembly 40 may be configured to operate in the Ku-band, which corresponds to 10-14.5 GHz. As readily appreciated by those skilled in the art, the communications circuitry 50 and the antenna assembly 40 are not limited to these frequency bands and the satellite 20 may be configured to operate at a different frequency band.

Figure 3:
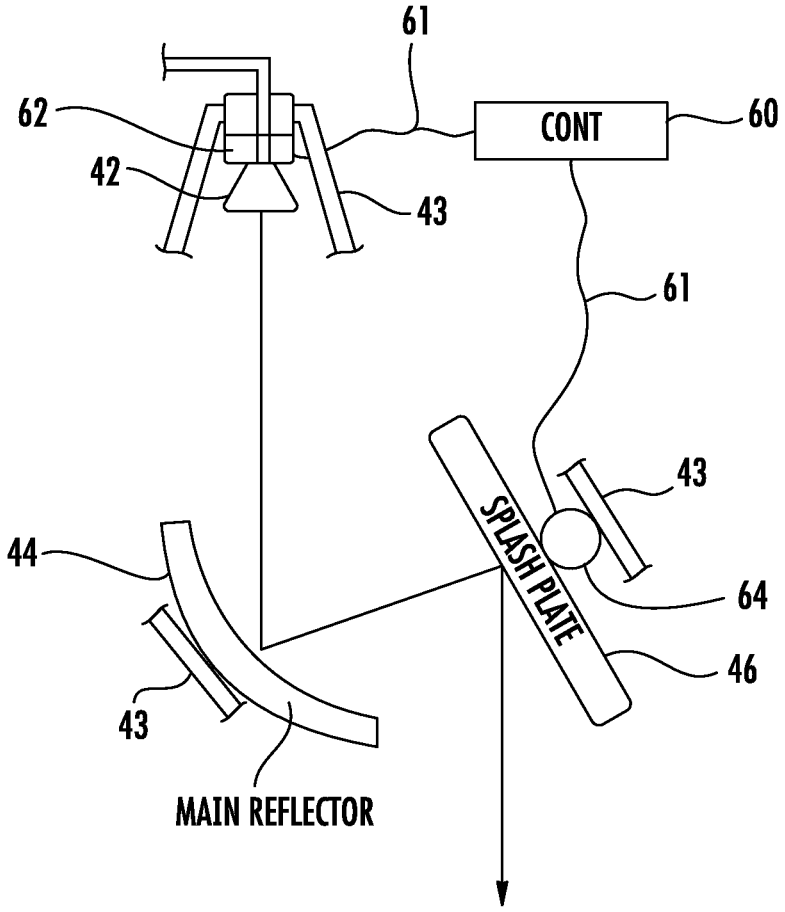
FIG. 3 is a block diagram of a controller connected to rotational actuators for steering the antenna assembly illustrated in FIG. 1.

Referring now to FIG. 3, a first rotational actuator 62 is coupled between the antenna feed 42 and the frame 43. A second rotational actuator 64 is coupled between the frame 43 and the splash plate 46. A controller 60 is connected to the first and second rotational actuators 62, 64 via cabling 61 to control rotation of the antenna assembly 40. The controller 60 is configured to control the antenna assembly 40 to steer within a full spherical angular range, as readily appreciated by those skilled in the art.

Another advantage of the illustrated antenna assembly 40 is that wide scan angle performance is not sacrificed as a result of the compact geometry. TABLE 1 provides performance parameters for the main reflector 44 positioned at broadside, i.e., no scanning. Taking into account antenna efficiencies between an operating frequency of 17.7 to 30 Ghz, the net antenna gain is expected to vary between 32.4 to 36.6 dB.

The antenna assembly 40 produces an optically focused reflector antenna system. An optically focused arrangement is maintained as an antenna beam is scanned in elevation and azimuth, resulting in good antenna performance over the entire scan range.

TABLE 1

| Broadside (no scanning) | | | | |
|---|---|---|---|---|
| Freq. (GHz) | 17.7 | 19.3 | 27 | 30 |
| Diameter | 12 | 12 | 12 | 12 |
| Predicted Gain | 33.4 | 34.7 | 37.2 | 37.6 |
| Efficiency | 0.69 | 0.78 | 0.71 | 0.63 |
| Net Gain | 32.4 | 33.7 | 36.2 | 36.6 |

TABLE 2 provides performance parameters for the splash plate 46 positioned for a wide scan of 60 degrees from the antenna boresight (approximately 20 beamwidths of scan). Taking into account antenna efficiencies between the operating frequency of 17.7 to 30 Ghz, the net antenna gain is expected to vary between 28.5 to 32.2 dB. The difference between broadside and the maximum scan range for the net gain is −3.9 dB to −4.4 dB. Antenna performance is relatively stable over the wide angle scan range.

The difference between broadside and the maximum scan range for the net gain is −3.9 dB to −4.4 dB. Antenna performance is relatively stable over the scan angle range.

In addition, the antenna assembly may be configured to scan over 10 degrees of bandwidth. This corresponds to 20 scans to cover the +/−60 degree scan range. The scan ranges for the antenna assembly 40 are illustrative and are not to be limiting.

TABLE 2

| Maximum Scan (60 degrees) | | | | |
|---|---|---|---|---|
| Freq. (GHz) | 17.7 | 19.3 | 27 | 30 |
| Diameter | 12 | 12 | 12 | 12 |
| Predicted Gain | 29.5 | 30.3 | 33.2 | 34.2 |
| Efficiency | 0.28 | 0.28 | 0.28 | 0.29 |
| Net Gain | 28.5 | 29.3 | 32.2 | 32.2 |

Figure 4:
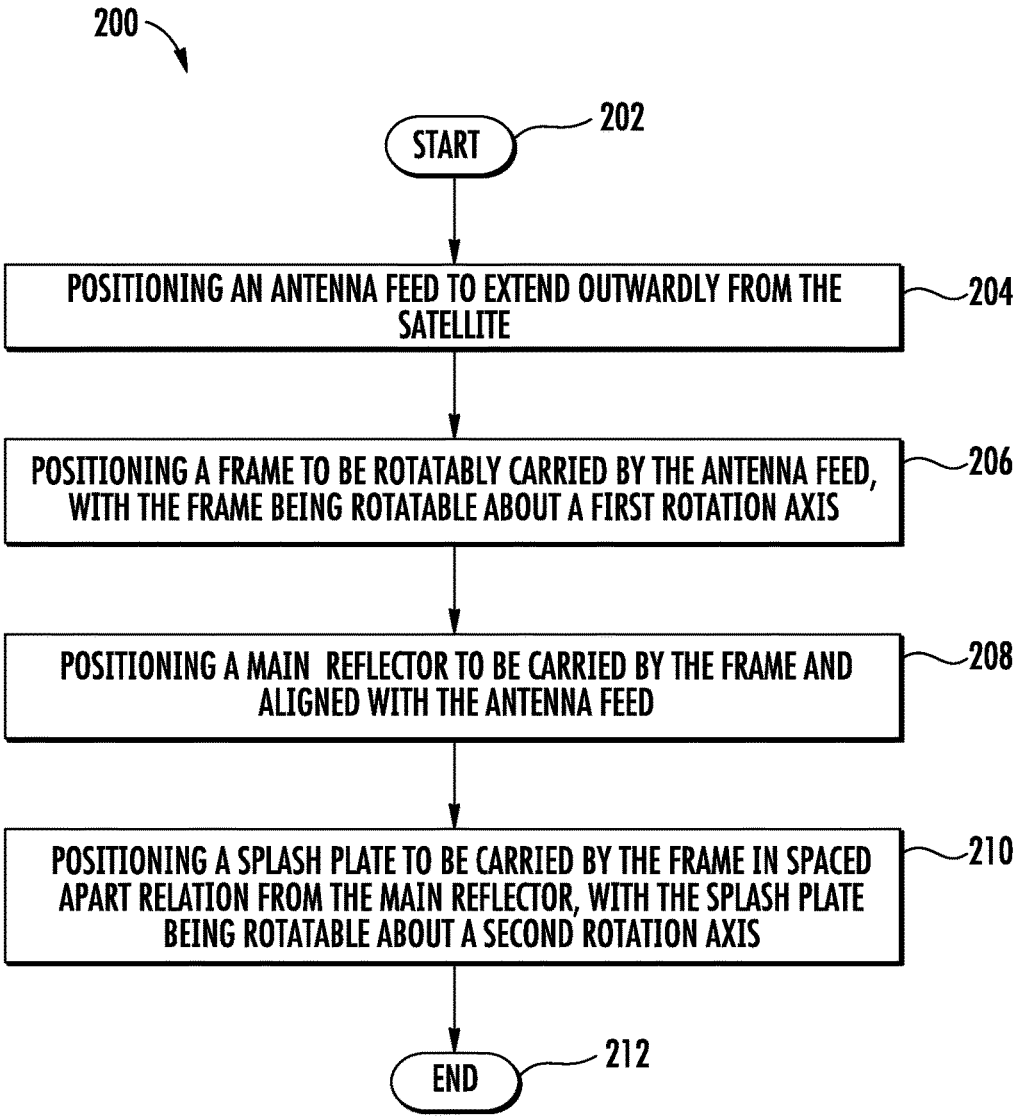
FIG. 4 is a flowchart of a method for making the antenna assembly illustrated in FIG. 1.

Referring now to the flowchart 200 illustrated in FIG. 4, a method for making an antenna assembly 40 to be carried by a satellite 20 as described above will be discussed. From the start (Block 202), the method comprises positioning an antenna feed 42 to extend outwardly from the satellite 20 at Block 204. A frame 43 is positioned to be rotatably carried by the antenna feed 42 at Block 206, with the frame being rotatable about a first rotation axis 70. A main reflector 44 is positioned to be carried by the frame 43 at Block 208. The main reflector 44 is aligned with the antenna feed 42. The method further comprises positioning a splash plate 46 to carried by the frame 43 in spaced apart relation from the main reflector 44 at Block 210. The splash plate 46 is rotatable about a second rotation axis 72. The method ends at Block 212.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna assembly to be carried by a satellite and comprising:

an antenna feed configured to extend outwardly from the satellite;

a frame rotatably carried by said antenna feed and being rotatable about a first rotation axis;

a main reflector carried by said frame and aligned with said antenna feed; and a splash plate carried by said frame, and positioned in spaced apart relation from said main reflector without a subreflector therebetween so that said main reflector is positioned along a path between said antenna feed and said splash plate, and so that said splash plate is rotatable about a second rotation axis.

2. The antenna assembly according to claim 1 wherein said antenna feed has an L-shape.

3. The antenna assembly according to claim 1 wherein said main reflector is fixed to said frame.

4. The antenna assembly according to claim 1 further comprising a first rotational actuator coupled between said antenna feed and said frame.

5. The antenna assembly according to claim 1 further comprising a second rotational actuator coupled between said frame and said splash plate.

6. The antenna assembly according to claim 1 wherein the first rotation axis provides azimuthal positioning, and wherein the second rotation axis provides elevational positioning.

7. The antenna assembly according to claim 1 wherein said main reflector has a parabolic shape, and said splash plate has a flat shape.

8. The antenna assembly according to claim 1 wherein said main reflector is configured to operate in at least one of the Ka-frequency band and the Ku-frequency band.

9. A satellite comprising:

a housing;

communications circuitry carried by said housing; and an antenna assembly comprising an antenna feed configured to extend outwardly from said housing and coupled to said communications circuitry, a frame rotatably carried by said antenna feed and being rotatable about a first rotation axis, a main reflector carried by said frame and aligned with said antenna feed, and a splash plate carried by said frame, and positioned in spaced apart relation from said main reflector without a subreflector therebetween so that said main reflector is positioned along a path between said antenna feed and said splash plate, and so that said splash plate is rotatable about a second rotation axis.

10. The satellite according to claim 9 wherein said antenna feed has an L-shape.

11. The satellite according to claim 9 wherein said main reflector is fixed to said frame.

12. The satellite according to claim 9 further comprising a first rotational actuator coupled between said antenna feed and said frame; and a second rotational actuator coupled between said frame and said splash plate.

13. The satellite according to claim 9 wherein the first rotation axis provides azimuthal positioning, and wherein the second rotation axis provides elevational positioning.

14. The satellite according to claim 9 wherein said main reflector has a parabolic shape, and said splash plate has a flat shape.

15. The satellite according to claim 9 wherein said communications circuitry and said main reflector are each configured to operate in at least one of the Ka-frequency band and the Ku-frequency band.

16. A method for making an antenna assembly to be carried by a satellite and comprising:

positioning an antenna feed to extend outwardly from the satellite;

positioning a frame to be rotatably carried by the antenna feed, with the frame being rotatable about a first rotation axis;

positioning a main reflector to be carried by the frame and aligned with the antenna feed; and positioning a splash plate to be carried by the frame, and positioning the splash plate in spaced apart relation from the main reflector without a subreflector therebetween so that the main reflector is positioned along a path between the antenna feed and the splash plate, and so that the splash plate is rotatable about a second rotation axis.

17. The method according to claim 16 wherein the antenna feed has an L-shape.

18. The method according to claim 16 wherein the main reflector is fixed to the frame.

19. The method according to claim 16 further comprising:

coupling a first rotational actuator between the antenna feed and the frame; and coupling a second rotational actuator between the frame and the splash plate.

20. The method according to claim 16 wherein the first rotation axis provides azimuthal positioning, and wherein the second rotation axis provides elevational positioning.

21. The method according to claim 16 wherein the main reflector has a parabolic shape, and the splash plate has a flat shape.

22. The method according to claim 16 wherein the main reflector is configured to operate in at least one of the Ka-frequency band and the Ku-frequency band.

* * * * *